United States Patent [19]

Goodman

[11] Patent Number: 4,596,529

[45] Date of Patent: Jun. 24, 1986

[54] MOUNTING ASSEMBLY FOR INFLATABLE BOAT AND ELECTRIC MOTOR

[76] Inventor: Steven Goodman, 85 Oak St., Norwood, N.J. 07648

[21] Appl. No.: 763,522

[22] Filed: Aug. 8, 1985

[51] Int. Cl.[4] ..... B63H 21/26

[52] U.S. Cl. ..... 440/6; 114/345; 440/53

[58] Field of Search ..... 440/40–42, 440/53, 6, 7; 114/345, 165; 248/640

[56] References Cited

U.S. PATENT DOCUMENTS 600,874 3/1898 Jones ..... 440/53

1,686,366 10/1928 Boyle ..... 114/345

FOREIGN PATENT DOCUMENTS 576561 4/1946 United Kingdom ..... 114/345

*Primary Examiner*—Sherman D. Basinger

*Attorney, Agent, or Firm*—Peter L. Berger

[57] ABSTRACT

An inflatable portable boat is disclosed having a pair of spaced apart sockets or aperture members attached to the rear of the boat. An electric motor is provided with a housing having upper and lower pins. The sockets are spread apart to allow insertion of the pins, and when released, the sockets hold the motor assembly in place. A handle is inserted in the upper pin of the motor housing to allow the motorboat to be turned within the sockets to provide directional control for the motorboat.

6 Claims, 3 Drawing Figures

MOUNTING ASSEMBLY FOR INFLATABLE BOAT AND ELECTRIC MOTOR

BACKGROUND OF THE INVENTION

This invention relates to an improved mounting means for allowing a battery driven electric motor to be attached to an inflatable lightweight plastic boat.

With increased recreational water use, there has come the need to provide an inexpensive inflatable power driven boat. Such boats are available, but are relatively expensive. One problem with such prior boats relates to providing a motor which may be properly attached to the boat so as to minimize the cost of the assembly, yet provide an effective mounting apparatus for the motor to be connected to the boat.

An object of this invention is to provide an improved mounting system for enabling an electric motor to be effectively and quickly attached to the rear of an inflatable boat.

Still another object of this invention is to provide such an assembly which is quick and easy to use, yet is secure in ensuring that the electric motor is fixedly connected to the rear of the boat.

Still another object of this invention is to provide such a mounting means which is effectively sealed to the rear of the boat so as to prevent leakage, yet is flexible enough to allow the motor to be attached to the boat and be rotated there within.

Another object of this invention is to provide such a portable boat and motor which is inexpensive to manufacture and which will be susceptible of widespread use.

Other objects, advantages and features of this invention will become more apparent from the following description.

SUMMARY OF THE INVENTION

In accordance with the principles of this invention, I provide a combination of an inflatable boat and a motor connected thereto, the inflatable boat having a pair of spaced-apart aperture supporting members located at the rear of the boat being movable with respect to each other, the motor comprising a housing which itself has oppositely directed pins, the upper of the pins being inserted in one of the aperture support members, while the other of the pins inserted in the lower of the support members. Since the boat is inflatable, it is flexible and the aperture support members are spread apart to allow the pins of the motor assembly to be inserted, yet when released, the support members will hold the pins so that the motor is attached to the boat. The upper pin is provided with a square socket, and a handle is provided having a square pin inserted into the square socket of the upper pin. In this way, the handle is able to turn the small electric motor, which is capable of then providing directional control for the boat.

DETAILED DESCRIPTION

Figure 1:
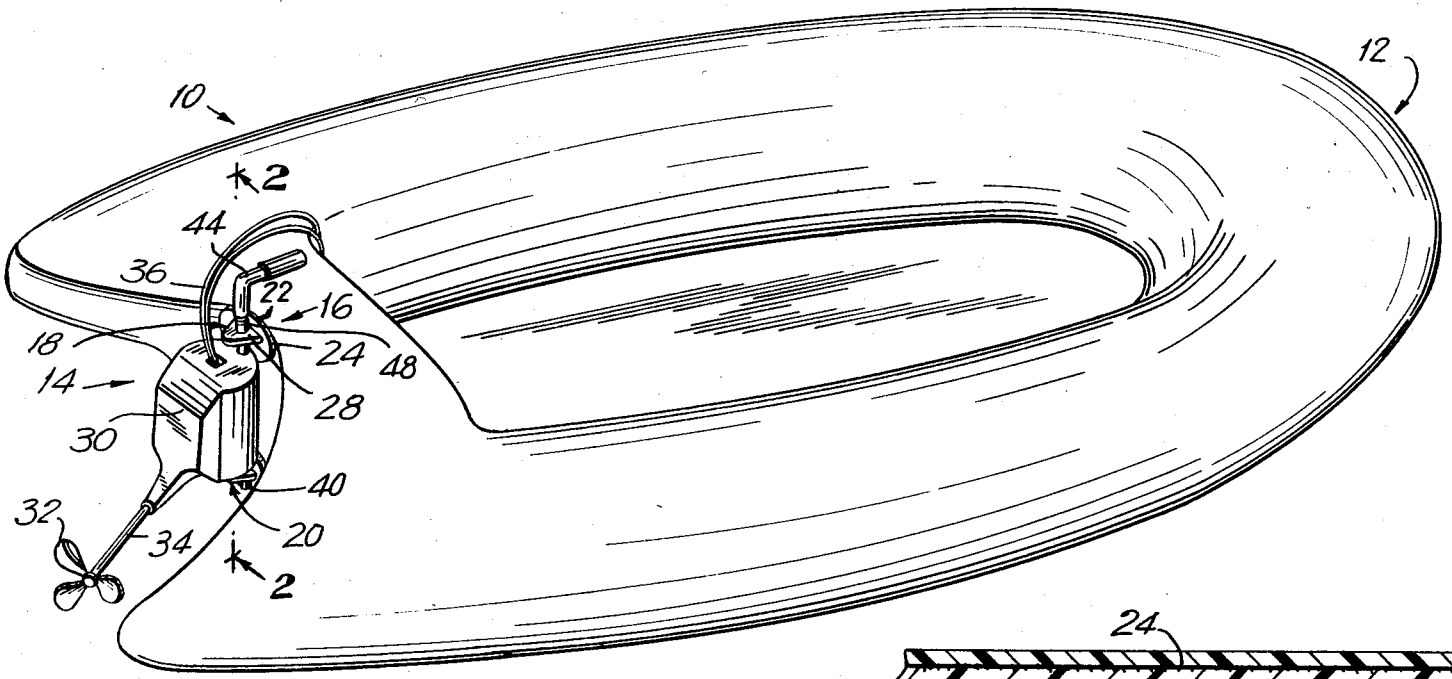
FIG. 1 is a perspective view showing the inflatable boat and motor attached thereto.
Figure 3:
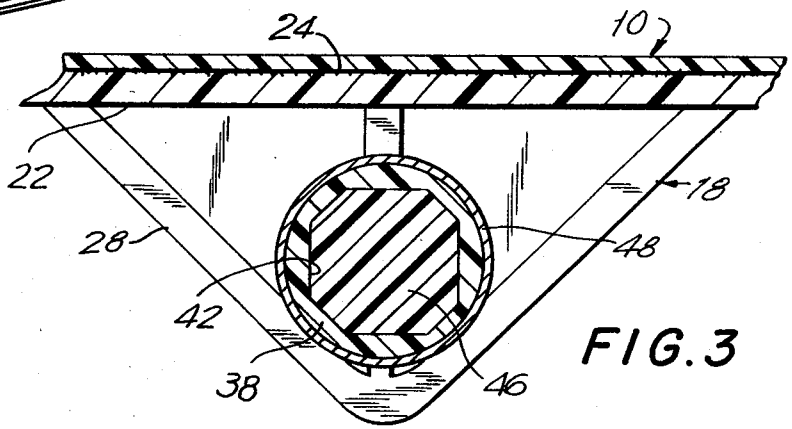
FIG. 3 is a sectional view along the lines 3—3 showing the handle being attached to the upper pin for providing directional control of the boat.
Figure 2:
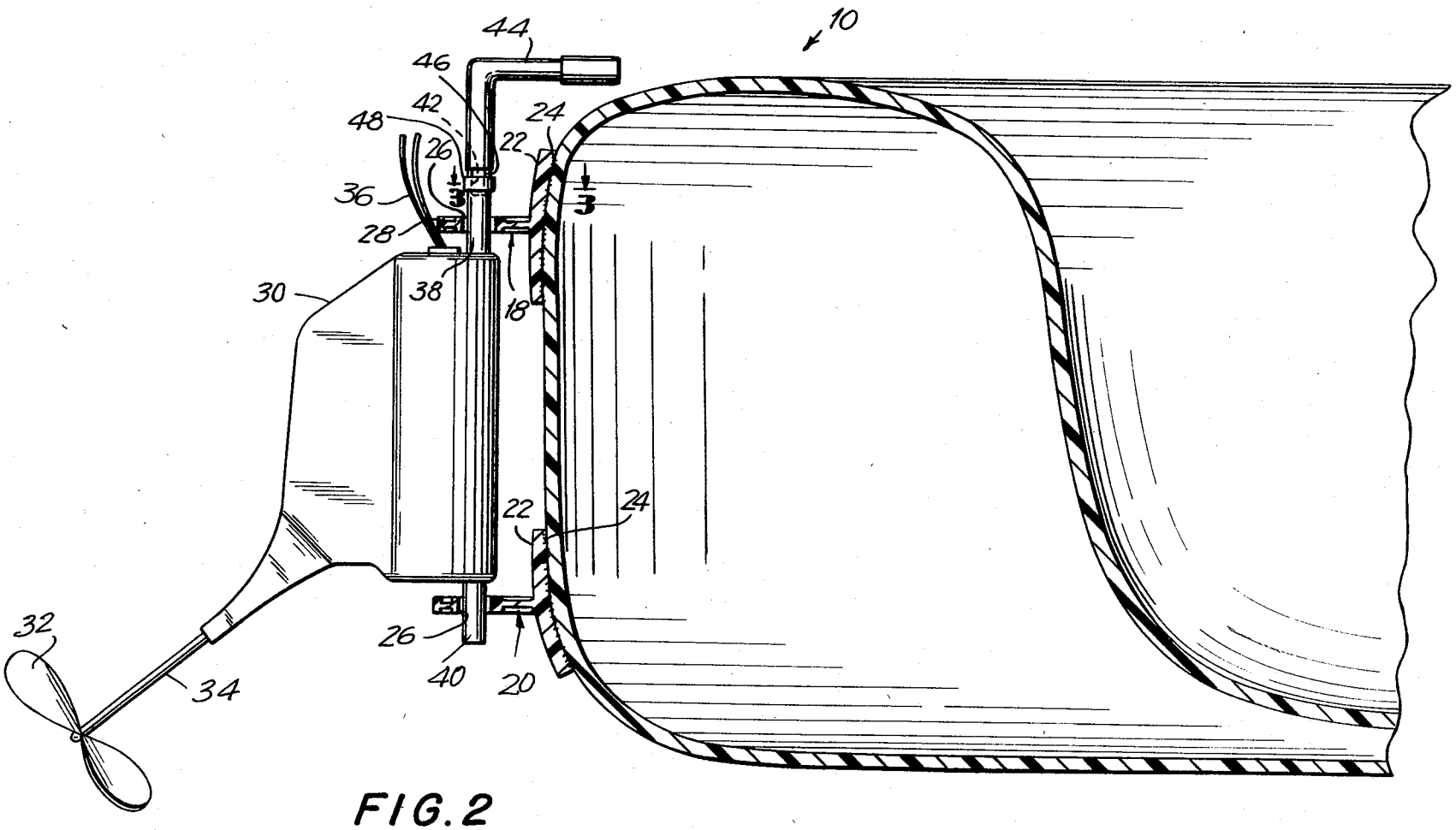
FIG. 2 is a sectional view along the lines 2—2 showing the motor housing being attached to the rear of the boat.

FIG. 1 illustrates an inflatable boat 10 having a front 12 and a rear 14. Any inflatable boat may be used in this regard, but the boat must be provided of a sufficiently thick vinyl or other plastic material to prevent easy rupturing or puncturing of the boat.

At the center 16 of the rear of the boat, there are provided a pair of spaced apart aperture support members 18 and 20, the upper support member indicated as 18, while the lower is indicated as 20. Each aperture support member is provided with a triangular plastic construction having a base 22 which is sealed as by sonic seals 24 so as to provide a secure and effective attachment of the aperture support members to the rear of the boat. The triangular support members have apertures 26 formed in one vertex of the triangular plastic member, and a web construction 28 is provided for the triangular plastic member to provide structural support.

The electric motor is held within a housing 30, preferably made of plastic, with a propeller 32 connected to a drive shaft 34 which is driven by an electric motor housed within housing 30. The electric motor is battery driven, and a pair of wires 36 extend from the top of the housing to be connected to a battery (not shown) carried within the boat. The housing 30 comprises an upper pin 38 and a lower pin 40 integrally formed with the housing. These pins are spaced apart, and are adapted to be inserted within the apertures 26 of the aperture support members 18 and 20. Since the boat is relatively flexible, even when fully inflated, the upper and lower aperture support members are relatively movable with respect to each other. These members are spread apart, so as to receive and guide the upper and lower pins 38 and 40, respectively, and when the upper and lower aperture support members 18 to 20 are released, the housing of the motor will be firmly attached to the boat by the respective upper and lower pin and aperture support member connections. As may be readily understood, the pins are rotatable within the aperture support members, so as to allow the motor to be turned to provide directional control for the boat.

The upper pin 38 is provided with a receptacle 42 of a generally square shape. An L-shaped handle 44 is provided having a square shape pin 46 inserted into receptable 42 so as to be able to move and turn the motor to provide the above-said directional control. A band 48 is provided around the upper pin 38 to effectively secure the pin together and to tighten the pin so as to ensure that the pin and receptacle 42 securely hold handle 44.

This invention has been described with regard to one preferred mounting embodiment system, but others may be devised by those of ordinary skill in the art without departing from the spirit and teaching of this invention.

What is claimed is:

1. In combination, an inflatable boat and a motor, said inflatable boat comprising a pair of spaced apart aperture support members located at the rear of said boat, said aperture support members attached to the rear of said boat and movable with respect to each other, said motor comprising a housing and a propeller driven by said motor, said housing comprising spaced apart oppositely directed pins, one of said pins insertable in one of said aperture support members, the other of said pins inserted in the other of said aperture support members, said aperture support members being spread apart to receive said pins and guide and hold said pins and motor as said aperture support members are released from being spread apart, the upper of said pins comprising a socket, a handle for steering said boat by turning said motor, said handle being inserted in said socket of said upper pin, said handle turning said motor about said spaced-apart aperture support members and pin connections.

2. The combination as set forth in claim 1, wherein said inflatable boat comprises a vinyl material, said vinyl material being flexible when said boat is fully inflated to allow said spaced-apart aperture support members to be spread apart to receive said oppositely directed pins.

3. The combination as set forth in claim 1, wherein said spaced-apart aperture support members are formed of triangular plastic members having a base attached to the rear surface of the boat and a web, one vertex of said triangular plastic member terminating in said aperture of said aperture support members.

4. The combination as set forth in claim 1, wherein the socket of said upper pin comprises a square receptacle, said handle comprising an L-shape with the portion of said handle inserted in said square shaped socket also comprising a complementary square shape.

5. The combination as set forth in claim 1, comprising a band slid onto the upper pin to secure said handle in said upper pin.

6. The combination as set forth in claim 1, wherein said motor is a battery driven electric motor and said housing is sealed enclosing said motor.

* * * * *